US011761064B2

(12) United States Patent
Jackson et al.

(10) Patent No.: US 11,761,064 B2
(45) Date of Patent: Sep. 19, 2023

(54) REFRACTORY METAL ALLOY

(71) Applicant: Raytheon Technologies Corporation, Farmington, CT (US)

(72) Inventors: Richard Wesley Jackson, Mystic, CT (US); John A. Sharon, West Hartford, CT (US); Ryan M. Deacon, Colchester, CT (US)

(73) Assignee: RTX CORPORATION, Farmington, CT (US)

( * ) Notice: Subject to any disclaimer, the term of this patent is extended or adjusted under 35 U.S.C. 154(b) by 0 days.

(21) Appl. No.: 17/126,775

(22) Filed: Dec. 18, 2020

(65) Prior Publication Data

US 2022/0195565 A1 Jun. 23, 2022

(51) Int. Cl.
*C22C 27/04* (2006.01)

(52) U.S. Cl.
CPC ..... *C22C 27/04* (2013.01)

(58) Field of Classification Search
None
See application file for complete search history.

(56) References Cited

U.S. PATENT DOCUMENTS 3,814,447 A * 6/1974 Prasse ..... C22C 27/04 428/663
3,988,118 A * 10/1976 Grierson ..... C22C 1/045 75/248
4,668,310 A * 5/1987 Kudo ..... H01F 1/153 148/304
4,863,526 A * 9/1989 Miyagawa ..... C22C 19/07 420/439
5,595,616 A 1/1997 Berczik
5,683,524 A 11/1997 Subramanian et al.
5,693,156 A 12/1997 Berczik
6,497,968 B2 12/2002 Zhao et al.
6,652,674 B1 * 11/2003 Woodard ..... C22C 1/045 148/423
10,329,926 B2 6/2019 Lenz et al.
2006/0147335 A1 * 7/2006 Bewlay ..... C22C 27/02 420/425

(Continued)

FOREIGN PATENT DOCUMENTS

CN 103394685 B * 6/2015
DE 102018206359 10/2019

(Continued)

OTHER PUBLICATIONS

Machine translation Yonezu et al. (JP 2001262290 A) (translated by Espacenet Jun. 23, 2021) (Year: 2001).*

(Continued)

*Primary Examiner* — Elizabeth Collister
(74) *Attorney, Agent, or Firm* — Carlson, Gaskey & Olds, P.C.

(57) ABSTRACT

A refractory metal alloy includes at least three metal components. At least one of the metal components is a refractory metal selected from the group of Mo, Nb, W, Ti, V, Cr, Mn, Y, Zr, Hf, Ta, Fe, Co, Al, Mn. The refractory metal alloy also includes two nonmetal components. The refractory metal alloy comprises non-trace amounts of each of the metal components and each of the nonmetal components. A component is also disclosed.

10 Claims, 2 Drawing Sheets

(56) References Cited

U.S. PATENT DOCUMENTS

| | | | | |
|---|---|---|---|---|
| 2006/0169369 | A1* | 8/2006 | Jehanno | C22C 37/04 148/423 |
| 2006/0285990 | A1* | 12/2006 | Jehanno | C22C 1/045 419/29 |
| 2007/0020136 | A1* | 1/2007 | Menon | C22C 27/02 420/426 |
| 2014/0141281 | A1* | 5/2014 | Kadokura | C22C 27/04 428/662 |
| 2014/0356215 | A1* | 12/2014 | Yamazaki | B22F 3/15 419/13 |
| 2016/0060734 | A1* | 3/2016 | Smarsly | C22C 27/04 420/429 |
| 2016/0273368 | A1* | 9/2016 | Smarsly | B23K 26/21 |
| 2017/0213959 | A1* | 7/2017 | Gibson | H01L 45/142 |
| 2017/0241271 | A1* | 8/2017 | Fried | C23C 16/56 |
| 2018/0105901 | A1* | 4/2018 | Smarsly | B22F 9/04 |
| 2021/0238717 | A1* | 8/2021 | Kruger | F01D 5/28 |

FOREIGN PATENT DOCUMENTS

| | | | | |
|---|---|---|---|---|
| EP | 2799163 | | 11/2014 | |
| GB | 842487 | | 7/1960 | |
| JP | 2001262290 | | 9/2001 | |
| JP | 2001262290 | A * | 9/2001 | |
| WO | WO-2019234016 | A1 * | 12/2019 | C22C 1/045 |

OTHER PUBLICATIONS

Machine translation Kruger et al. (WO 2019/234016 A1) (translated by Espacenet Jun. 23, 2021) (Year: 2019).*

Machine translation of CN 103394685 B translated via Espacenet on May 19, 2022 (Year: 2015).*

Mendiratta, M.G., Effect of Alloying Additions on the Phase Equilibria and Oxidation in the Mo—Si—B System. Apr. 2001. Interim Report for Period Jun. 30, 1998-Jun. 30, 2000. Wright-Patterson Air Force Base, OH.

Extended European search report for European patent application No. 21215165.8 dated May 6, 2022.

* cited by examiner

REFRACTORY METAL ALLOY

BACKGROUND

A gas turbine engine typically includes a fan section, a compressor section, a combustor section and a turbine section. Air entering the compressor section is compressed and delivered into the combustion section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

Refractory metals typically have high melting points and are therefore an attractive choice for various applications within the gas turbine engine. Refractory metals can be alloyed with other elements in order to improve certain properties, such as oxidation resistance. However, there are unique challenges to creating refractory metal alloys with improved properties that are suitable for use in gas turbine engines.

SUMMARY

A refractory metal alloy according to an exemplary embodiment of this disclosure, among other possible things includes at least three metal components. At least one of the metal components is a refractory metal selected from the group of Mo, Nb, W, Ti, V, Cr, Mn, Y, Zr, Hf, Ta, Fe, Co, Al, Mn. The refractory metal alloy also includes two nonmetal components. The refractory metal alloy comprises non-trace amounts of each of the metal components and each of the nonmetal components.

In a further example of the foregoing, the refractory metal includes molybdenum.

In a further example of any of the foregoing, the two nonmetal components are silicon and boron.

In a further example of any of the foregoing, the two nonmetal components together comprise at least 10 atomic percent of the refractory metal alloy.

In a further example of any of the foregoing, the at least three metal components are selected from the group of Mo, V, Ta, Cr, Nb, and W.

In a further example of any of the foregoing, the three metal components include Mo, Ta, and Cr.

In a further example of any of the foregoing, the at least three metal components are M1, M2, and M3. The atomic percent of M1≥M2≥M3, and wherein the atomic percent of M1<50.

In a further example of any of the foregoing, M1 is Mo.

In a further example of any of the foregoing, one of M2 and M3 is Nb.

In a further example of any of the foregoing, one of M2 and M3 is W.

A component according to an exemplary embodiment of this disclosure, among other possible things includes a refractory metal alloy, including molybdenum, a second metal component M2, a third metal component M3, silicon, and boron. The atomic percent of molybdenum≥M2≥M3, and wherein the atomic percent of molybdenum<50.

In a further example of the foregoing, the atomic percent of the silicon and boron together is at least 10 atomic percent.

In a further example of any of the foregoing, M2 and M3 are refractory metals.

In a further example of any of the foregoing, M2 and M3 are selected from the group of Ta, Ti, Cr, V, Nb, W, Fe, Co, Al, Mn and Y.

In a further example of any of the foregoing, one of M2 and M3 is Nb.

In a further example of any of the foregoing, M2 has a larger atomic volume than M1 and M3 has a smaller atomic volume than M1.

In a further example of any of the foregoing, the component also includes a fourth metal component.

In a further example of any of the foregoing, the second, third, and fourth metal components are selected from the group of V, Ta, Cr, Nb, and W.

In a further example of any of the foregoing, the atomic percent of the silicon and boron together is at least 20 atomic percent.

In a further example of any of the foregoing, the component is a component of a gas turbine engine.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
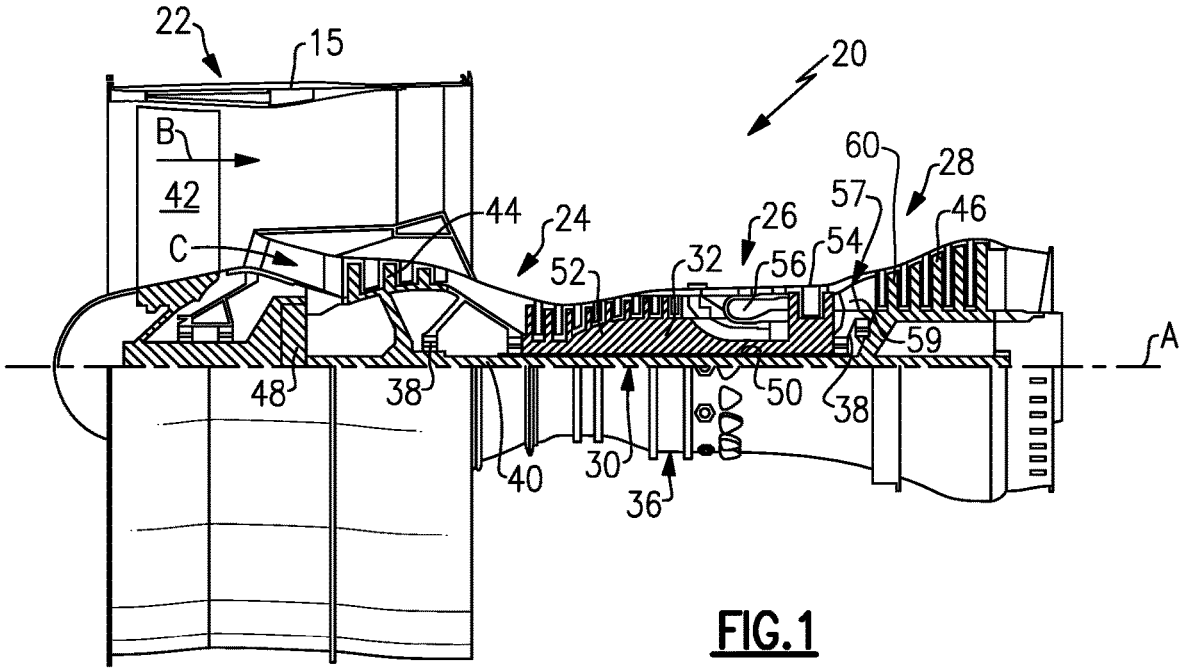
FIG. 1 illustrates an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a nacelle 15, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded through the high pressure turbine 54 and low pressure turbine 46. The mid-turbine frame 57 includes airfoils 59 which are in the core airflow path C. The low pressure turbine 46 incudes airfoils 60. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), the geared architecture 48 is an epicyclic gear train, such as a planetary gear system or other gear system, with a gear reduction ratio of greater than about 2.3 and the low pressure turbine 46 has a pressure ratio that is greater than about five. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45. "Low corrected fan tip speed" is the actual fan tip speed in ft/sec divided by an industry standard temperature correction of [(Tram ° R)/(518.7° R)]^0.5. The "Low corrected fan tip speed" as disclosed herein according to one non-limiting embodiment is less than about 1150 ft/second (350.5 meters/second).

Figure 2:
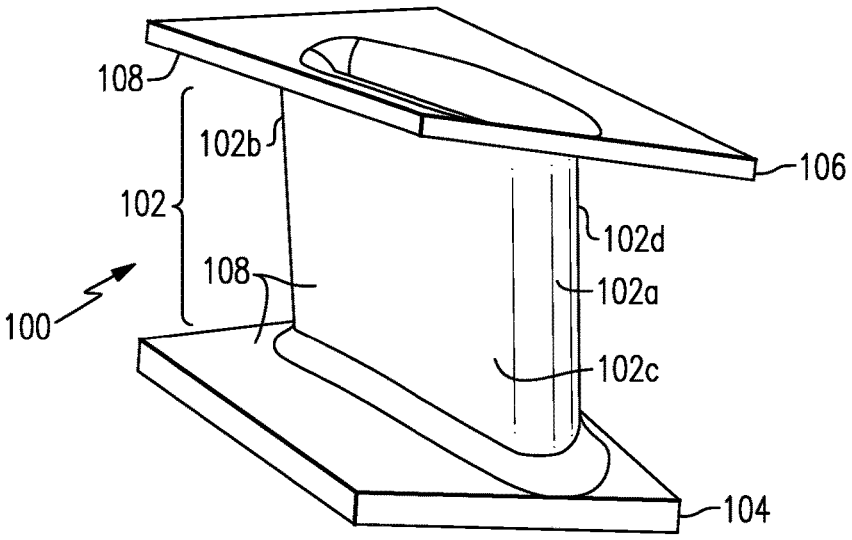
FIG. 2 illustrates an example component for the gas turbine engine of FIG. 1.

Gas turbine engines include harsh environments and therefore there is a need for materials with high temperature capability, high strength balanced with sufficient ductility, and good oxidation resistance. The materials described herein can be used in various gas turbine engine 20 components described above, such as in the combustor section 26, or in the turbine/compressor sections 28/24. FIG. 2 shows one non-limiting example component comprising the material described herein, which is a representative airfoil 100 used in the turbine engine 20 (see also FIG. 1). As shown, the airfoil 100 is a turbine vane; however, it is to be understood that, although the examples herein may be described and shown with reference to turbine vanes, this disclosure is also applicable to blades. Moreover, it should be understood that the description herein is applicable to other types of gas turbine engine 20 components, and is not limited to airfoils. Additionally, the material composition described herein could be used for applications other than gas turbine engines.

In the illustrated example, the airfoil 100 includes an airfoil section 102 that delimits an aerodynamic profile. Airfoil section 102 defines a leading end 102*a*, a trailing end 102*b*, and first and second sides 102*c*/102*d* that join the leading end 102*a* and the trailing end 102*b*. The terminology "first" and "second" as used herein is to differentiate that there are two architecturally distinct components or features. It is to be further understood that the terms "first" and "second" are interchangeable in the embodiments herein in that a first component or feature could alternatively be termed as the second component or feature, and vice versa. In this example, the first side 102*c* is a pressure side and the second side 102*d* is a suction side. The airfoil section 102 generally extends in a radial direction relative to the central engine axis A. For a vane, the airfoil section 102 spans from a first or inner platform 104 to a second or outer platform 106. The terms "inner" and "outer" refer to location with respect to the central engine axis A, i.e., radially inner or radially outer. For a blade, the airfoil section 102 would extend from a single inner platform to a free end.

The airfoil section 102 and platforms 104/106 together constitute an airfoil piece. For a blade, the airfoil piece would include only the airfoil section 102 and platform 104. In one example, the airfoil piece is formed of a single, continuous wall 108 that defines the complete or substantially complete shape and contour of the airfoil section 102 and platforms 104/106. In this regard, the airfoil 100 is a unibody construction.

Figure 3A:
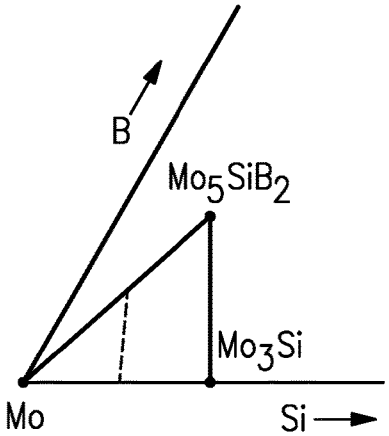
FIG. 3*a* illustrates a schematic phase diagram for a Mo—Si—B alloy.
Figure 3B:
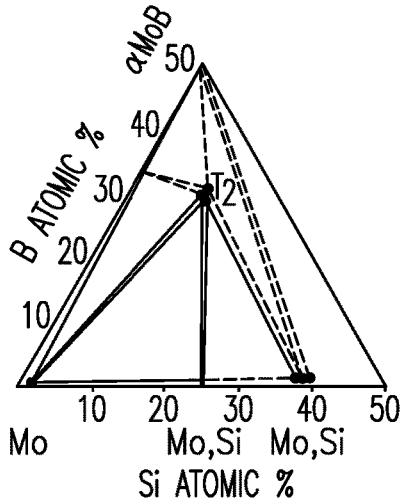
FIG. 3*b* illustrates a phase diagram for a Mo—Si—B alloy at 1600 degrees C.

Molybdenum is known to have a high melting point and good temperature resistance properties. However, molybdenum is susceptible to environmental attack, such as oxidation. Alloying molybdenum with silicon and boron improves the oxidation resistance of the molybdenum. FIG. 3*a* shows a schematic phase diagram of the Mo-rich region of a Mo—Si—B alloy. FIG. 3*b* shows a phase diagram of the Mo-rich region of a Mo—Si—B alloy at 1600 degrees C. As shown in FIGS. 3*a*-*b*, three phases are present: a body-centered-cubic (BCC)-Mo phase, $Mo_5SiB_2$ (known as T2), and $Mo_3Si$ (known as A15). The BCC-Mo is primarily composed of Mo, but can contain a few atomic % Si (e.g, less than 3 atomic %) under certain conditions and less amounts of B. In general, the BCC-Mo phase contributes to the ductility of the alloy, and alloys having at least 50 volume percent BCC-Mo have satisfactory ductility for use in harsh environments such as a gas turbine engine 20. In FIG. 3*a*, the dashed line represents the range of alloy composition that have 50 volume percent BCC-Mo. However, the BCC phase can have limited creep resistance at elevated temperatures. The T2 and A15 phases contribute to the strength of the alloy. Thus the combination of BCC phase(s) and strengthening phase(s) such as T2 and A15 are needed to provide an alloy satisfactory for harsh environments.

Silicon and boron contribute to the oxidation resistance for the Mo—Si—B alloy. Without being bound by any particular theory, the oxidation resistance stems from the fact that the silicon and boron are reactive with oxygen, and the reaction products (e.g., borosilicate oxide scale) limit the transport of oxidants (e.g. oxygen and water vapor) to the alloy, thus dramatically decreasing the rate at which the alloy reacts with oxygen. However, as shown in the phase diagram (FIGS. 3*a-b*), increasing the atomic percent of silicon and boron increases the amount of A15 phase while decreasing the amount of BCC-Mo phase. Therefore, an alloy with a significant atomic percent of silicon may have insufficient ductility. Accordingly, for the Mo—Si—B system, there is only a limited amount of silicon and boron that can be added; otherwise, the alloy will not be suitable for gas turbine engine or other applications. However, the A15 phase has a high Mo:Si ratio (3:1) and a molar volume comparable to BCC-Mo, which results in the ratio of atomic concentration of Si in the bulk alloy to volume of A15 to be low (e.g., much of the silicon tends to be found in the A15 phase). Table 1 below shows compositions of five example Mo—Si—B alloys, each having a volume % of BCC-Mo equal to 50.0. As shown in the table, alloys with more silicon tend to form large amounts of the A15 phase. For instance, Example E has 7.5 atomic % Si and 5.4 volume % A15 phase. But increasing the atomic % of Si to 11.8 in Example A drastically increases the volume % of the A15 phase to 41.6.

TABLE 1

| | Atomic % | | | | | Volume % | | |
|---|---|---|---|---|---|---|---|---|
| | Mo | Si | B | Si + B | Si:B | BCC-Mo | A15 | T2 |
| Example A | 85.7 | 11.8 | 2.5 | 14.3 | 4.72 | 50.0 | 41.6 | 8.4 |
| Example B | 84.3 | 10.7 | 5.0 | 15.7 | 2.15 | 50.0 | 33.0 | 17.0 |
| Example C | 82.8 | 9.7 | 7.5 | 17.2 | 1.29 | 50.0 | 24.1 | 25.9 |
| Example D | 81.4 | 8.6 | 10.0 | 18.6 | 0.86 | 50.0 | 14.9 | 35.1 |
| Example E | 80.0 | 7.5 | 12.5 | 20.0 | 0.60 | 50.0 | 5.4 | 44.6 |

Figure 4:
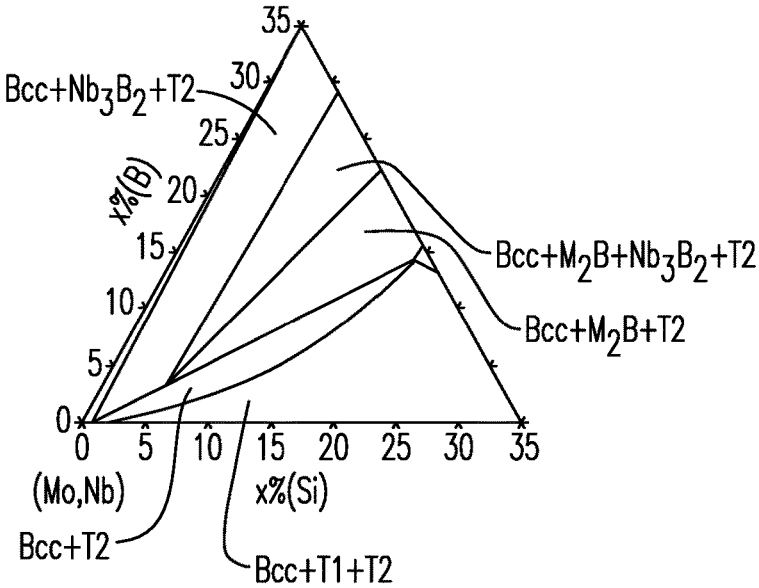
FIG. 4 illustrates a phase diagram for an Mo—Nb—Si—B alloy.

Disrupting the formation of the A15 phase would produce an alloy with improved mechanical and oxidation resistance properties by allowing for more silicon and boron to be added without reducing/eliminating the ductile BCC-Mo phase. One way to disrupt the formation of the A15 phase is to add additional metals to the alloy. For example, a phase diagram for the Mo—Nb-rich region of a Mo—Nb—Si—B alloy at 1500 degrees C. is shown in FIG. 4. As shown, this alloy forms a T1 phase rather than the A15 phase, which contributes to the strength of the alloy. The T1 phase has a body-center tetragonal structure, and in this example is $(Mo,Nb)_5Si_3$. The T1 phase has a lower ratio of metallic elements to silicon (Mo,Nb):Si=(1.67:1) as compared to the A15 phase, which allows the ratio of the Si concentration in the alloy to the volume of T1 in the alloy to be higher. Moreover, significant amounts of silicon and boron can be added without significantly reducing/eliminating the ductile BCC phases. Thus systems which allow for the formation of the T1 phase are preferable to those that do not.

The same principle generally applies to other alloys. In general, the combination of strengthening phases and ductile phases provide an improved material for gas turbine engine and other applications. The strengthening phases can vary depending on the alloy. For instance, some alloys can have more than one T1 phase, depending on the number of metals present in the alloy. For example, the Mo—Nb—Si—B alloy discussed above may have four phrases, a BCC phase, a Mo-rich T1 phase, a Nb-rich T1 phase, and T2. Likewise, some alloys can have more than one boride- and/or silicon-containing phase such as A15 in the example discussed above. Other alloys will also have different BCC phases, depending on the metal(s) present. The formation of one or more T1 phases, again depending on the metal(s) present, disrupts the formation of silicon-rich phases like A15, which allows the ratio of the Si concentration in the alloy to the Si concentration in the T1 phase to be higher.

Figure 5:
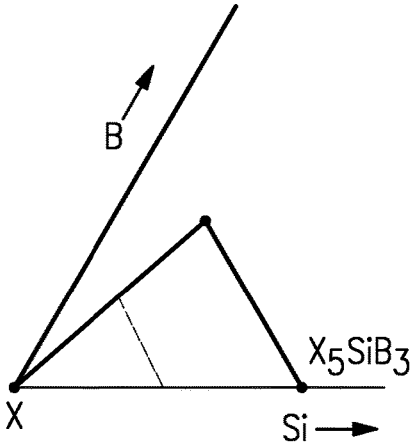
FIG. 5 illustrates a schematic phase diagram for an example X—Si—B alloy, where X is a combination of metals.

FIG. 5 shows a schematic phase diagram for an example X—Si—B alloy, where X is a combination of metals "X" represents the non-Si and non-B constituents of the alloy, e.g., the metallic constituents of the alloy, and could include two or more metals. For instance, in the example of FIG. 4 discussed above, X would represent Mo and Nb. Other examples, such as those discussed throughout this application, are also contemplated. Table 2 below shows compositions of five example X—Si—B alloys, each having an approximated volume % of BCC phase equal to 50.0. In FIG. 5, the dashed line represents the range of alloy composition that have 50.0 volume percent BCC-X. As compared to those examples in Table 1, the examples in Table 2 have significantly higher Si atomic % and significant amounts of the T1 phase.

TABLE 2

| | Atomic % | | | | | Volume % | | |
|---|---|---|---|---|---|---|---|---|
| | X | Si | B | Si + B | Si:B | BCC-X | T1 ($X_5Si_3$) | T2 ($X_5SiB_2$) |
| Example A | 80.2 | 17.3 | 2.5 | 19.8 | 6.91 | 50.0 | 41.5 | 8.5 |
| Example B | 80.0 | 15.0 | 5.0 | 20.0 | 3.00 | 50.0 | 32.9 | 17.1 |

TABLE 2-continued

| | Atomic % | | | | | Volume % | | |
|---|---|---|---|---|---|---|---|---|
| | X | Si | B | Si + B | Si:B | BCC-X | T1 ($X_5Si_3$) | T2 ($X_5SiB_2$) |
| Example C | 79.8 | 12.7 | 7.5 | 20.2 | 1.70 | 50.0 | 23.9 | 26.1 |
| Example D | 79.5 | 10.5 | 10.0 | 20.5 | 1.05 | 50.0 | 14.8 | 35.2 |
| Example E | 79.3 | 8.2 | 12.5 | 20.7 | 0.66 | 50.0 | 5.3 | 44.7 |

Adding two or more metals, such as refractory metals, to the Mo—Si—B alloy further improves the properties of the material beyond those properties of a system that comprises only one additional metal. Refractory metals in particular easily crystallize into the BCC structure over a wide temperature range (in some cases, from room temperature up to the melting point). For example, Ta, Ti, Cr, V, Nb, W, and Y all provide systems with a stable T1 phase. Nb, W, and Y in particular provide systems with an unstable T2 phase. Adding two or more metals to the Mo—Si—B system improves the oxidation resistance of the resulting material and also contributes to the strength of the BCC phase(s) by providing solid solution strengthening, and therefore contributes to the strength of the resulting material as compared to prior art refractory metal alloys.

The magnitude of the solid solution strengthening can be increased when metals are added that have apparent atomic volumes that differ from the apparent atomic volume of the base metal. For alloys with multiple metallic elements present in non-trace amounts, such as those described herein, apparent atomic volume can be approximated for the BCC phase of each metallic element. Apparent atomic volume can be approximated by any known method. In one example, if the element is BCC, apparent atomic volume is approximated as $A^3/2$, where A is the known lattice parameter taken from any known reference. In another example, average apparent atomic volume can be approximated by extrapolating from a high-temperature BCC form of the element. In a third example, the average apparent atomic volume can be approximated from atomistic simulations.

The solid solution strengthening effect is most pronounced when elements having a different size from the base metal are included in the alloy. For example, two elements are added with atomic volumes that are higher and lower, respectively, than the base metal. It has been proposed that the misfit solutes (e.g., those with different sizes than the base metal) inhibit the motion of edge-dislocation. A list of apparent atomic volumes for elements in a BCC lattice are given in Table 3 below. Additionally, the presence of additional metals can limit the activity of metals that form volatile oxides, such as Mo, which oxidizes to $MoO_3$ and W, which oxidizes to $WO_3$.

TABLE 3

| Element | Apparent Atomic Volume, $A^3$ | Group | Group | Group |
|---|---|---|---|---|
| Zr | 22.980 | M2 | M2 | M2 |
| Hf | 22.540 | | | |
| Ta | 18.019 | | | |
| Nb | 17.980 | | | M1 |
| Ti | 17.612 | | | M3 |
| Co | 16.686 | | | |
| W | 15.854 | | M1 | |
| Mo | 15.583 | M1 | M3 | |
| Al | 14.952 | M3 | | |
| V | 13.824 | | | |
| Mn | 12.245 | | | |

TABLE 3-continued

| Element | Apparent Atomic Volume, $A^3$ | Group | Group | Group |
|---|---|---|---|---|
| Cr | 12.002 | | | |
| Fe | 11.777 | | | |
| Si | — | | | |
| B | — | | | |

The additional metals can be selected to optimize the mechanical properties (e.g., strength and ductility) of the material while maximizing the oxidation resistance of the material.

Returning again to FIG. 2, one or more components of the airfoil 100 such as the wall 108 comprises a refractory metal alloy. The wall 108 may be exposed to a temperature gradient during operation of the gas turbine engine 20 because air traveling inside the wall 108 may be cooler than air traveling outside the wall 108. Therefore, the wall 108 should be comprised of a material that has good temperature resistance, among other qualities that will be discussed in more detail below.

The refractory metal alloy includes at least five atomic components. Each of the components comprises non-trace amounts of the refractory metal alloy, e.g., each of the five components makes up at least 5 atomic percent of the refractory metal alloy. Additionally, no single atomic component makes up greater than 50 atomic of the refractory metal alloy. "Atomic percent" refers to the percent of atoms in the refractory metal alloy, and therefore differs from weight percent or volume percent (though it may be related to weight/volume percent, in some examples).

Two of the five atomic components of the refractory metal alloy are nonmetals. One of the nonmetals is silicon. The other of the nonmetals is boron and/or carbon. The refractory metal alloy includes at least three metallic components. At least two of the metallic components are refractory metals, though in some examples, all of the metallic components are refractory metals. The refractory metals could be Mo, Nb, W, Ti, V, Cr, Mn, Fe, Co, Y, Zr, Hf, or Ta. Molybdenum-Rhenium alloys tend to form a brittle sigma phase instead of the ductile BCC phase.

An example refractory metal alloy has at least three metal components $M_1$, $M_2$, and $M_3$, where the atomic percent of $M_1 \geq M_2 \geq M_3$. The atomic percent of $M_1$ is less than or equal to 50%. The atomic percent of $M_3$ is greater than 10%. In one example, one of $M_1$, $M_2$, and $M_3$ is molybdenum. In a particular example, $M_1$ is molybdenum. In another particular example, $M_1$ is molybdenum and $M_2$ is niobium, which is known to have high strength.

In some examples, $M_2$ has a larger apparent atomic volume than $M_1$, and $M_3$ has a smaller apparent atomic volume than $M_1$. For such examples, example options for $M_1$, $M_2$, and $M_3$ metals are shown in Table 3, above. As noted above, a solid solution strengthening effect is most pronounced when two elements ($M_2$ and $M_3$) are added with atomic volumes that are higher and lower, respectively, than the base metal (in this case, $M_1$).

Another example refractory metal alloy has four metallic components. More particularly, the metallic components are refractory metal alloys selected from the group of Mo, V, Ta, Cr, Nb, and W, wherein Mo comprises at least 15 atomic percent of the alloy. In one example, the refractory metal alloy includes Mo, Ta, and Cr along with a fourth metal selected from the foregoing group. Tantalum and chromium can contribute to the oxidative stability of the alloy because tantalum and chromium can selectively oxidize to form $TaCrO_4$.

The sum of the two non-metal components is at least 10 atomic percent. In a further example, the sum of the two non-metal components is at least 15 atomic percent. In a further example, the sum of the two non-metal components is between 15 and 20 atomic percent. In a particular example, the non-metal components are silicon and boron. In a further example, the refractory metal alloy includes at least 10 atomic percent silicon, and less than 10 atomic percent boron. In a more particular example, the refractory metal alloy includes 10 atomic percent silicon and 5 atomic percent boron.

The refractory metal alloy has at least three phases. One of the phases is a BCC phase that forms a percolating continuous matrix in the refractory metal alloy. In one example, one of the remaining two phases is $Mo_5SiB_2$.

Table 4 shows the atomic composition of some specific example refractory metal alloys according to the foregoing description:

TABLE 4

| | Atomic % | | | | | | | |
|---|---|---|---|---|---|---|---|---|
| | Si | B | Mo | W | Nb | V | Ta | Cr |
| Example 1 | 15 | 5 | 45 | 20 | 15 | 0 | 0 | 0 |
| Example 2 | 10 | 10 | 45 | 20 | 15 | 0 | 0 | 0 |
| Example 3 | 8 | 12 | 45 | 20 | 15 | 0 | 0 | 0 |
| Example 4 | 15 | 5 | 20 | 20 | 0 | 0 | 20 | 20 |
| Example 5 | 20 | 5 | 45 | 20 | 10 | 0 | 0 | 0 |
| Example 6 | 15 | 5 | 30 | 20 | 15 | 0 | 15 | 15 |
| Example 7 | 15 | 5 | 15 | 15 | 5 | 15 | 15 | 15 |

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A refractory metal alloy, comprising:

at least four metal components, wherein one of the metal components is W or Ta, two of the remaining three metal components are selected from the group of Nb, V, Cr, and the other of W or Ta, wherein the at least three of the four metal components are $M_1$, $M_2$, and $M_3$, wherein the atomic percent of $M_1 \geq M_2 \geq M_3$, and wherein the atomic percent of $M_1 < 50$, wherein $M_1$ is Mo and wherein when Nb is present, the Nb is present in an amount that is less than the amount of Mo; and two nonmetal components, wherein the refractory metal alloy comprises at least 10 atomic percent of each of the metal components and at least 5 atomic percent of each of the nonmetal components, wherein the two nonmetal components together comprise less than 20 atomic percent of the refractory metal alloy.

2. The refractory metal alloy of claim 1, wherein the two nonmetal components are silicon and boron.

3. The refractory metal alloy of claim 1, wherein three of the four metal components include Mo, Ta, and Cr.

4. The refractory metal alloy of claim 1, wherein one of $M_2$ and $M_3$ is Nb.

5. The refractory metal alloy of claim 1, wherein one of $M_2$ and $M_3$ is W.

6. The refractory metal alloy of claim 1, wherein the two nonmetal components together comprise between 15 and 20 atomic percent of the refractory metal alloy.

7. A component, comprising:

a refractory metal alloy, including molybdenum, a second metal component $M_2$, a third metal component $M_3$, a fourth metal component, silicon, and boron, wherein the atomic percent of molybdenum$\geq M_2 \geq M_3$, and wherein the atomic percent of molybdenum<50, wherein one of the second metal component $M_2$ and the third metal component $M_3$ are W or Ta, and wherein one of $M_2$ and $M_3$ is Nb, wherein each of molybdenum, the second metal component, and the third metal component comprise at least 10 atomic percent of the refractory metal alloy, and wherein the combined atomic percent of silicon and boron is less than 20 atomic percent.

8. The component of claim 7, wherein $M_2$ and $M_3$ are refractory metals.

9. The component of claim 7, wherein $M_2$ has a larger atomic volume than molybdenum and $M_3$ has a smaller atomic volume than molybdenum.

10. The component of claim 7, wherein the component is a component of a gas turbine engine.

* * * * *